United States Patent [19]

Hinkley

[11] 3,966,561

[45] June 29, 1976

[54] APPARATUS FOR THE CARBONIZATION OF COAL

[75] Inventor: David William Hinkley, Brighton Beach, Australia

[73] Assignee: International Oils Exploration N.L., Melbourne, Australia

[22] Filed: Sept. 23, 1974

[21] Appl. No.: 508,263

[52] U.S. Cl. ..... 202/117; 201/6; 201/15; 201/27; 201/32; 201/36; 202/135; 202/137; 202/108

[51] Int. Cl.² ..... C10B 1/06; C10B 7/06; C10B 21/00

[58] Field of Search ..... 202/117, 92, 108, 109, 202/135, 137, 215, 224, 228; 201/6, 16, 27, 32, 36, 39, 43, 15; 264/29

[56] References Cited

UNITED STATES PATENTS

| | | | |
|---|---|---|---|
| 3,010,882 | 11/1961 | Barclay et al. | 264/29 UX |
| 3,013,951 | 12/1961 | Mansfield | 202/117 X |
| 3,331,754 | 7/1967 | Mansfield | 202/228 X |
| 3,441,480 | 4/1969 | Ban | 201/27 X |
| 3,546,076 | 12/1970 | Muller et al. | 201/6 |
| 3,560,369 | 2/1971 | Rowland et al. | 202/117 X |
| 3,591,462 | 7/1971 | Bretz | 201/27 X |

FOREIGN PATENTS OR APPLICATIONS

| | | | |
|---|---|---|---|
| 616,187 | 1/1927 | France | 202/117 |

*Primary Examiner*—Joseph Scovronek
*Assistant Examiner*—Bradley R. Garris
*Attorney, Agent, or Firm*—Sheridan, Ross & Fields

[57] ABSTRACT

Carbonization of coal in travelling grate furnace with hot gas inlets below the grate. A refractory screen is provided above the grate to provide a flame propagation base for the volatile gases withdrawn from the coal on the grate. The combustion zone above the refractory screen provides radiant heat to vaporize volatiles present in the coal on the grate.

The coal to be treated may be in the form of briquettes or an extruded slab. When an extruded slab of slurried coal is used the thermal shock on first entering the carbonization chamber results in the formation of carbon granules.

18 Claims, 2 Drawing Figures

APPARATUS FOR THE CARBONIZATION OF COAL

The present invention is concerned with the carbonization of coal, especially of low rank coals having a high volatiles content.

Australian Pat. Nos. 420,124 and 419,760 disclose processes of carbonizing coal using a travelling grate furnace in which hot air for combustion is passed through the grate to react with the hydrocarbons in the coal and form a primary combustion zone on the coal bed on the travelling grate which combustion zone provides the necessary ignition heat for the carbonization process.

A fault with the carbonization process of the above patents is that carbon loss occurs in the coal on the travelling bed due to further reaction with the oxygen in the hot air passing upwardly through the coal and also due to oxidation by flame surge effects from the over fire combustion zone on the traveling bed. Such carbon loss is particularly serious in association with higher value demineralized and briquette low rank coals which are particularly reactive and subject to deformation of size and shape.

To overcome this problem, it is an object of the present invention to provide an apparatus and a process whereby carbon loss from coal on a travelling bed is reduced and density is increased.

To this end, the present invention provides apparatus for the carbonization of coal which includes a travelling bed, adapted to carry the coal to be carbonized, disposed with a carbonization chamber, hot gas inlets in said carbonization chamber disposed below said travelling bed, a combustion chamber disposed above said travelling bed and separated from said carbonization chamber by a screen having perforations therein to allow for passage of hot gas passing from said inlets through said travelling bed to said combustion chamber, and air inlets in said combustion chamber to support combustion of coal volatiles carried by said hot gases, the heat of the combustion chamber heating said screen which generates radiant heat for the carbonization chamber.

The screen, preferably of refractory material, which separates the combustion zone from the carbonization zone acts as a flame propagation base for the combustion zone. The heat of combustion which is released adjacent the screen raises the temperature of the screen to a point where high intensity infra red radiation is generated by the underside of the screen. This radiation penetrates the coal on the travelling bed and raises the temperature more uniformly than the direct heat of combustion as utilized in prior art methods previously mentioned. The temperature of the coal bed may be regulated by monitoring the following parameters; location of combustion air injectors, distance of screen from coal bed, volume of sweeper gas passing through coal bed, and location of supplementary fuel injectors into combustion chamber. Any combination of these parameters may be regulated to provide the temperature control for the carbonization chamber. This controlled heating of the coal reduces the initial thermal shock encountered upon entry into the furnace and the occurrence of coal particle fissuring and thus provides a particle of improved strength compared to products of prior art processes.

A further advantage of the present invention is that the prevention of carbon loss from the coal reduces surface porosity of the coal being carbonized and this results in an improvement in overall particle density compared to prior art processes.

In the prior art processes mentioned above the primary air was fed into the carbonization space as the hot sweeper gas and thus reacted with the carbon in the coal as well as carrying away the coal volatiles. It is a preferred feature of this invention to use an inert gas as the sweeper gas and to inject the primary combustion air into the combustion chamber without entering the carbonization chamber. By eliminating oxygen from the hot sweeper gas and introducing primary air above the travelling coal bed oxidation of the coal is avoided and carbon loss is substantially reduced. Inert gas of varying temperature at controlled velocities can be used for this purpose.

By using a briquetted feed to the carbonization chamber a product is obtained which needs crushing to produce a sharp edged carbon electrode stock. An alternative method of obtaining stock of this sort is also provided by the present invention. A gelatinized brown coal slurry is extruded onto a travelling grate and carried through a carbonization chamber as described above, except that at the entrance to the chamber there is provided a combustion zone at a temperature such that ignition and thermal shock reduces moisture in the extruded slab such that differentials in surface/interior tensions cause slug break up and subsequent exposure of interior surfaces to drying gases and infra red heat waves in the drying zone of the carbonizer.

In this alternative method the carbonization chamber is longer, having an initial thermal shock zone followed by the drying and carbonizing zone. A slab about 1¼ inches thick and 6 or 12 feet wide (preferably in several parallel streams) is reduced to sharp edged granules of ⅜ to ½ inch in size by this technique. The extruded slab initially contains 69–70% moisture. The control of the temperature profile in the drying zone following thermal shock ensures that internal shrinkage forces are maximized in drying the brown coal gels. This results in improved particle strength and prevents surface degradation during carbonization when the evolution of volatile gases is liable to create excessive porosity and density loss.

There will now be described a practical embodiment of the invention incorporating a number of preferred features as well as those essential features outlined above. The coal feed used is preferably a de-ashed brown coal in the form of briquettes or pellets.

FIG. 1 illustrates the general plant layout while

Figure 1:
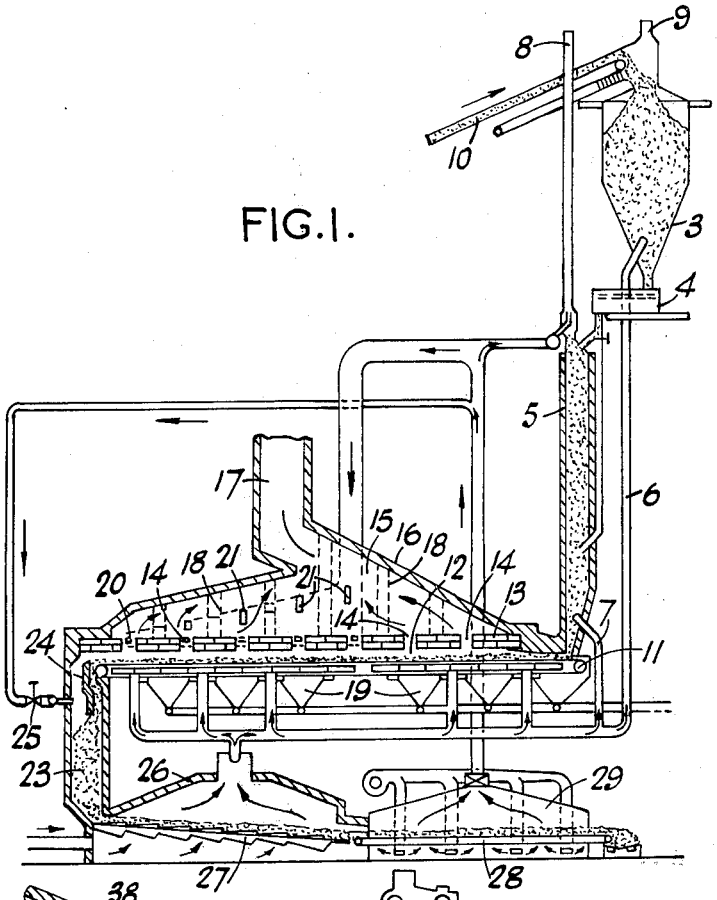

The carbonization plant includes at the coal feed inlet end a conveyor 10 linked with a feed hopper 3 from which coal is fed to a weight scale 4 and thence to a vertical shaft pre-dryer 5 so that the coal entering the dryer is metered in predetermined quantities. Hot inert gas passes upwardly through the coal from pipe 7 in the pre-dryer shaft. The residence time in the shaft is controlled by the initial feed rate from the hopper via the weight scale. Hot inert gas via pipe 6 is also fed into the feed hopper to initiate pre-drying prior to entry of the coal into the shaft pre-dryer. The hot inert gas exhausted from the feed hopper and the shaft dryer via flues 8 and 9 is ducted to exhaust stacks. The coal leaving the base of the shaft dryer usually contains 5% of initial moisture.

Coal from the base of the shaft pre-dryer is fed past a thermal barrier (not shown) which is preferably a water cooler onto a travelling grate 11 preferably in a thin even layer across the grate, which supports the coal through a carbonizing chamber 12. The ceiling 13 of the carbonizing chamber 12 is a refractory screen, laterally arched, having at predetermined intervals holes 14 in its surface which lead into a combustion zone 15 above said refractory screen.

The combustion zone 15, the floor of which is the refractory screen 13, is defined by a ceiling 16 sloping upwardly from that part of the combustion zone adjacent to the coal feed entry to approximately the centre of the combustion zone. At this point, the ceiling of the combustion zone is joined to the flue gas outlet 17 and the ceiling then slopes downwardly toward that section of the combustion zone adjacent the end of the carbonizing chamber. The ceiling and the refractory screen are connected by vertical refractory pillars 18 disposed at regular intervals on the surface of the screen between the afore-mentioned holes 14.

Inert gas inlets 19 are disposed beneath said travelling grate to sweep the gas through said grate 11 and through the holes 14 in said screen 13 into the combustion zone 15. Primary air inlets 20 are disposed between the pillars 18 in said combustion zone, and are adjacent the holes 14 in the screen surface so that the air which is preheated reacts with the hot inert gas carrying coal volatiles to initiate combustion. Preferably, the primary air is directed slightly upwardly over the holes to draw the hot carrier gas upwards into the initial combustion zone just above the refractory zone. The primary air nozzle 20 may incorporate supplementary nozzles for the injection of additional fuel or fuel gas to provide additional heat if required. Secondary air enters at inlets 21 above said primary air inlets 20 to form an over fire zone which completes combustion and assists in the formation of a stable combustion zone to heat said refractory screen.

The flue gases from said combustion zone are withdrawn through the outlet 17 in the central portion of the ceiling of the combustion chamber and may be utilized in heat exchangers to provide process heat for other parts of the plant after which some can be recycled for use as sweeper gas.

The heat of the combustion absorbed by the refractory screen causes the underside of the screen 13 to generate controlled radiant infra red heat along the length of the carbonization zone through which the travelling grate carries the coal. The initial and lower temperatures adjacent the entry to the carbonization chamber serves to heat the coal to complete dehydration and to commence vapourization of volatiles. The hot inert gas passing through the grate assists in the removal of the volatiles without reacting with the carbon. The middle section and the section adjacent the exit provide the main radiant heated carbonization zone as these zones are directly below the main combustion area of the combustion zone.

The coal leaving the carbonization zone may be fed to a surge feed hopper 23 via a drop breaker 24 alongside of which air is metered through inlet 25 to burn off evolving gases released by the sensible heat of the coal.

The product leaving the surge feed hopper is then fed to an inert gas cooling zone 26 through which cool inert gas is passed. The heat absorbed by this cool inert gas is used to initiate drying of coal in the initial feed hopper and/or raise the temperature of the sweeper gas. A step shaker multiple link grate 27 is used in the first inert gas cooling zone and this conveys the product onto a chain mesh conveyor 28 which carries the product through an air cooling zone 29. The air heated in this product cooling zone is used as the primary and secondary air in the combustion zone 15 above the carbonization chamber 12. Product from the air cooling zone is then conveyed to storage silos (not shown).

Figure 2:
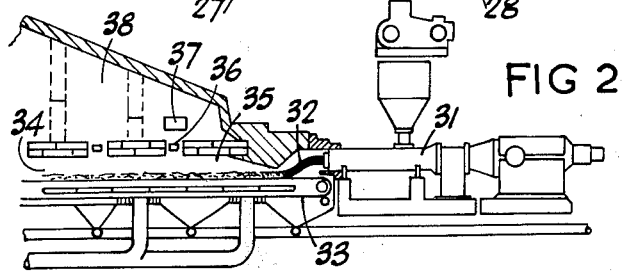
FIG. 2 illustrates an alternative feed arrangement.

FIG. 2 relates to the method where an extrusion machine 31 is used to extrude a slab 32 of brown coal gel onto travelling screen 33 similar to conveyor 10 of FIG. 1. The carbonization chamber 34 differs from that of chamber 12 shown in FIG. 1 as it is longer and includes the initial thermal shock zone 35. Primary air inlets 36 and secondary air inlet 37 provide an initial combustion zone in the combustion chamber 38. This initial combustion zone exists at the opposite end of the combustion chamber 38 which, after the initial combustion zone, is similar to that shown in FIG. 1.

The temperature profile of the chamber 34 is the same as for chamber 12 in FIG. 1 except that it includes the initial high temperature shock zone which is followed by the drying and carbonization zones as outlined for FIG. 1.

The carbonized granules obtained by using the extruded gel slab are given the same after-treatment as described for the briquette feed above.

From the above it can be seen that the present invention provides two means by which carbon loss is reduced during carbonization of coal. The present invention also provides in conjunction with the above advantage, a denser product of improved particle strength.

I claim:

1. Coal carbonization apparatus comprising a travelling grate disposed within a carbonization chamber and extending from at least the inlet to the outlet end of said carbonization chamber, hot inert gas inlets disposed in said carbonization chamber below said travelling grate, a combustion chamber disposed above said travelling grate and separated from said carbonization chamber by a perforated refractory screen, air inlets being disposed within said combustion chamber adjacent said refractory screen.

2. Apparatus as claimed in claim 1 in which said hot gas inlets are disposed at points along the length of the carbonization chamber and air inlets are disposed in the combustion chamber above the outlet end of the carbonization chamber.

3. Apparatus as claimed in claim 2 which includes a surge feed hopper disposed at said outlet end of said carbonization chamber below said travelling grate, a first cooling chamber adjacent the outlet from said surge hopper, a step shaker extending through said first cooling chamber to a travelling grate in a second cooling chamber.

4. Apparatus as claimed in claim 3 in which cooling gas inlets are disposed below said travelling grate and said step shaker in said cooling chambers and gas conduits extend from above said travelling grate and step shaker in said cooling chambers to said hot gas inlets in said carbonization chamber and to air inlets in said combustion chamber.

5. Apparatus as claimed in claim 3 which also includes a briquette feed hopper disposed above a vertical pre-drying shaft, said travelling grate in the carbonization chamber extending from beneath said shaft through said carbonization chamber.

6. Apparatus as claimed in claim 3 which includes an extrusion machine disposed on the inlet side of said carbonization chamber adjacent the front end of said travelling grate, an air inlet being disposed in said combustion chamber above the inlet end of said carbonization chamber.

7. In apparatus for carbonizing solid carbonaceous material including a travelling grate on which the solid carbonaceous material travelling through a carbonization zone is subjected to upwardly directed inert sweep gases at elevated temperatures for carbonization of the carbonaceous material and removal of volatiles therefrom, the improvement for avoiding oxidation of the carbonaceous material which comprises a foraminous element mounted above said travelling grate defining an upper combustion zone and a lower carbonization zone, means for introducing inert sweep gases upwardly through said travelling grate into said carbonization zone, means for passage of said sweep gases carrying volatile carbonization products from said carbonization zone to said combustion zone, and means for introducing oxygen-containing gases into said combustion zone to contact said inert gases and volatile products whereby said volatile products are oxidized.

8. Apparatus for carbonizing solid carbonaceous material including coal and oxidizing the resulting volatile products in separate zones, comprising:

an enclosure defined in part by a top having an outlet for effluent gas;

a travelling grate mounted for passage through said enclosure from an inlet to an outlet;

a refractory foraminous element mounted above said travelling grate substantially in the same plane as said travelling grate defining a carbonization zone between the refractory foraminous element and the travelling grate and defining a combustion zone between the refractory foraminous element and the top of said enclosure; means for introducing hot inert gas upwardly through said grate and into said carbonization zone whereby said solid material is carbonized and said volatile products are produced;

means for passage of said hot inert gas carrying volatile products of carbonization from said carbonization zone to said combustion zone;

means for introducing oxygen-containing gas, such as air or oxygen, into said combustion zone to contact said hot inert gas and volatile products whereby said volatile products are oxidized; and means for introducing solid carbonaceous material to be carbonized into the inlet of said enclosure and onto said grate.

9. Apparatus of claim 8 in which said means for introducing oxygen-containing gas into said combustion zone includes a primary means and a secondary means located at a point above the entry of oxygen-containing gas from said primary means.

10. Apparatus of claim 8 in which said primary means is arranged and constructed to introduce oxygen-containing gas upwardly into said hot inert gas entering said combustion zone.

11. Apparatus of claim 8 wherein said carbonization zone includes an initial pretreatment high-temperature, thermal-shock zone disposed at the inlet end of the carbonization zone for pre-treating extruded carbonaceous material so as to produce carbonaceous granules, the initial pre-treatment zone including means for introducing air into said pre-treatment zone above the inlet end of said carbonization chamber.

12. Apparatus of claim 8 in which the said oxygen-containing gas introducing means is located above the down-stream section of said carbonization zone.

13. Apparatus of claim 8 including a surge hopper at the outlet of said carbonization chamber to receive carbonized product leaving the carbonization chamber.

14. Apparatus of claim 13 including means for introducing air into said surge hopper to oxidize volatile products exiting the outlet of said carbonization chamber.

15. Apparatus of claim 13 including a first cooling zone for receiving the carbonized product from said surge hopper together with means for receiving cool inert gas to cool said carbonized product and heat said inert gas.

16. Apparatus of claim 15 including means for transferring said heated inert gas from the first cooling zone to said hot inert gas introducing means and to a preliminary heating means to heat incoming coal for the carbonization chamber.

17. Apparatus of claim 15 including a second cooling zone for receiving carbonized product from said first cooling zone together with means for receiving air to further cool said carbonized product and heat said air.

18. Apparatus of claim 17 including means for transferring heated air from said second cooling zone to said oxygen-containing gas introducing means.

* * * * *